US006365026B1

(12) United States Patent
Andrews et al.

(10) Patent No.: US 6,365,026 B1
(45) Date of Patent: Apr. 2, 2002

(54) LIMITED USE COMPONENTS FOR AN ELECTROCHEMICAL DEVICE AND METHOD

(75) Inventors: Craig C. Andrews, College Station; Oliver J. Murphy, Bryan, both of TX (US)

(73) Assignee: Lynntech, Inc., College Station, TX (US)

( * ) Notice: Subject to any disclaimer, the term of this patent is extended or adjusted under 35 U.S.C. 154(b) by 0 days.

(21) Appl. No.: 09/598,067

(22) Filed: Jun. 20, 2000

(51) Int. Cl.[7] ..... C25D 5/54; C25B 9/00

(52) U.S. Cl. ..... 205/85; 204/252; 204/257; 204/263

(58) Field of Search ..... 204/263, 257, 204/252, 290.01, 85

(56) References Cited

U.S. PATENT DOCUMENTS

| | | | | |
|---|---|---|---|---|
| 4,846,952 A | * | 7/1989 | Gardner et al. | 204/279 |
| 4,952,297 A | * | 8/1990 | Hicks et al. | 204/257 X |
| 5,529,683 A | | 6/1996 | Critz | |

FOREIGN PATENT DOCUMENTS

| | | |
|---|---|---|
| EP | 0 711 731 A3 | 5/1996 |
| EP | 0 771 731 A2 | 5/1996 |
| EP | 1 038 993 A1 | 9/2000 |
| JP | WO 01/61074 A1 | 8/2001 |

OTHER PUBLICATIONS

M. Pourbaix, et al.; LEAD(1); Chapter IV. Section 17.5; pp. 485–492, (No Date).

* cited by examiner

*Primary Examiner*—Donald R. Valentine
(74) *Attorney, Agent, or Firm*—Streets & Steele; Jeffrey L. Streets

(57) ABSTRACT

The present invention provides an ozone generating system that combines single-use elements or segments with an extended use fixture that is used to activate the single-use elements. One embodiment of the invention consists of a strip of proton exchange membrane (PEM) having the ozone producing catalyst applied directly onto one side of membrane. Optionally, the application of this catalyst may be divided into segments or patches, wherein each segment represents the limited-use portion of the ozone generator. Each segment may be advanced into a fixture that provides the balance of the electrochemical system required for operation of the ozone generator. This balance of system may include additional subsystems, with a power supply, water source, electrical contacts, electronic controllers, sensors and feedback components, being typical examples. After an individual segment is advanced into the operating fixture, the membrane may be hydrated by a water source and electrical contact made to the positive (anode) face of the membrane having the ozone generating catalyst and to the negative (cathode) side of the membrane which may also include a catalyst layer.

46 Claims, 11 Drawing Sheets

LIMITED USE COMPONENTS FOR AN ELECTROCHEMICAL DEVICE AND METHOD

BACKGROUND OF THE INVENTION

1. Field of the Invention

The invention relates to methods and apparatus for avoiding problems associated with extended use of electrochemical devices, namely degradation that can occur as a result of cycling the electrochemical device on and off.

2. Background of the Related Art

Ozone has long been recognized as a useful chemical commodity valued particularly for its outstanding oxidative activity. Because of this activity, it finds wide application in disinfection processes and the removal of cyanides, phenols, iron, manganese, and detergents. Thus, ozone has widespread application in many diverse activities, and its use would undoubtedly expand if its cost of production could be reduced. Furthermore, the relatively short half-life of ozone makes it difficult to distribute so it is generally produced on-site and usually very near the point of use. However, the cost of generating equipment, and poor energy efficiency of production has deterred its use in many applications and in many locations.

Because ozone has a very short life in the gaseous form, and an even shorter life when dissolved in water, it is preferably generated in close proximity to where the ozone will be consumed. Traditionally it is generated at a rate that is substantially equal to the rate of consumption since conventional generation systems do not lend themselves to ozone storage. Ozone may be stored as a compressed gas, but when generated using corona systems the pressure of the output gas stream is essentially at atmospheric pressure. Therefore, additional hardware for compression of the gas is required, which in itself reduces the ozone concentration through thermal degradation. Ozone may also be dissolved in liquids such as water but this process generally requires additional equipment to introduce the ozone gas into the liquid, and at atmospheric pressure and ambient temperature only a small amount of ozone may be dissolved in water.

Because so many of the present applications for ozone only have the need for relatively small amounts of ozone, it is generally not cost effective to use conventional ozone generation systems such as corona discharge. Furthermore, since many applications require the ozone to be delivered under pressure or dissolved in water, as for disinfection, sterilization, treatment of contaminants, etc., the additional support equipment required to compress and/or dissolve the ozone into the water stream further increases system cost.

Electrochemical cells in which a chemical reaction is forced by added electrical energy are called electrolytic cells. Central to the operation of any cell is the occurrence of oxidation and reduction reactions that produce or consume electrons. These reactions take pace at electrode/solution interfaces, where the electrodes must be good electronic conductors. In operation, a cell is connected to an external load or to an external voltage source, and electrons transfer electric charge between the anode and the cathode through the external circuit. To complete the electric circuit through the cell, an additional mechanism must exist for internal charge transfer. Internal charge transfer is provided by one or more electrolytes, which support charge transfer by ionic conduction. Electrolytes must be poor electronic conductors to prevent internal short-circuiting of the cell.

The simplest electrochemical cell consists of at least two electrodes and one or more electrolytes. The electrode at which the electron producing oxidation reaction occurs is the anode. The electrode at which an electron consuming reduction reaction occurs is called the cathode. The direction of the electron flow in the external circuit is always from anode to cathode.

Unfortunately, electrochemical ozone generators, especially those having lead dioxide as the anodic electrocatalyst, experience a performance degradation that gets worse with successive shutdowns of the generator or cell. This degradation manifests itself as an increasing voltage requirement of the cell. In some applications, this degradation can be avoided by providing a battery backup system that maintains a trickle current to the cell. In U.S. Pat. No. 5,529,683, Critz teaches that this problem can also be avoid by applying a reverse potential to the cell during shutdown. While these approaches to the problem may be sufficient in some applications, they both presume a continuing supply of electrical current.

Therefore, there is a need for an ozone generator system that operates efficiently on standard AC or DC electricity and water to deliver a reliable stream of ozone gas that is generated under pressure for direct use by the application. It would be desirable if the system was self-contained, self-controlled and required very little maintenance. It would be further desirable if the system had a minimum number of wearing components, a minimal control system, and be compatible with low voltage power sources such as solar cell arrays, vehicle electrical systems, or battery power. Finally, it would be desirable if the electrochemical cell were designed to overcome the cycling limitations inherent to existing electrochemical ozone generators without requiring the continued use of electrical current. It would be even more desirable if the electrochemical cell were designed to avoid or reduce other lifetime limiting effects, such as impure water.

SUMMARY OF THE INVENTION

The present invention provides an ozone generating system that combines single-use elements or segments with an extended use fixture that is used to activate the single-use elements. One embodiment of the invention consists of a strip of proton exchange membrane (PEM) having the ozone producing catalyst applied directly onto one side of membrane. Optionally, the application of this catalyst may be divided into segments or patches, wherein each segment represents the limited-use portion of the ozone generator. Each segment may be advanced into a fixture that provides the balance of the electrochemical system required for operation of the ozone generator. This balance of system may include additional subsystems, with a power supply, water source, electrical contacts, electronic controllers, sensors and feedback components, being typical examples. After an individual segment is advanced into the operating fixture, the membrane may be hydrated by a water source and electrical contact made to the positive (anode) face of the membrane having the ozone generating catalyst and to the negative (cathode) side of the membrane which may also include a catalyst layer.

After water and electrical contacts are provided to the limited-use segment, the system now forms the basic elements of an electrochemical cell that may be used for electrolysis. With the application of electrical current, the system will begin electrolyzing the available water to generate ozone which may then be utilized. The operation of the generator can then continue until the performance degrades to unacceptable levels or until the source of ozone is no longer required. At that time the electrical power may be shut off or the electrical contacts physically removed from the limited-use element. When the limited-use element has reached or neared its operating lifetime, the used segment may be removed from the fixture and a new segment advanced into position. In this manner, the process can continue with the limited lifetime components of the electrolyzer being completely replaced in a simple and potentially automated manner.

The concept of the limited-use element may be extended to include all the elements necessary for operation of the ozone generator that undergo degradation or consumption. While not intended to be an exhaustive list, these degradable or consumable elements may include the anodic catalyst, cathodic catalyst, membrane, performance indicators, water supply, and electrical supply. It may also be advantageous to include aspects of the product handling system as limited-use elements, such as including a hydrophobic, gas permeable membrane over the anode so that ozone gas may pass directly into a process stream without introducing other fluids into the cell.

BRIEF DESCRIPTION OF THE DRAWINGS

So that the above recited features and advantages of the present invention can be understood in detail, a more particular description of the invention, briefly summarized above, may be had by reference to the embodiments thereof, which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
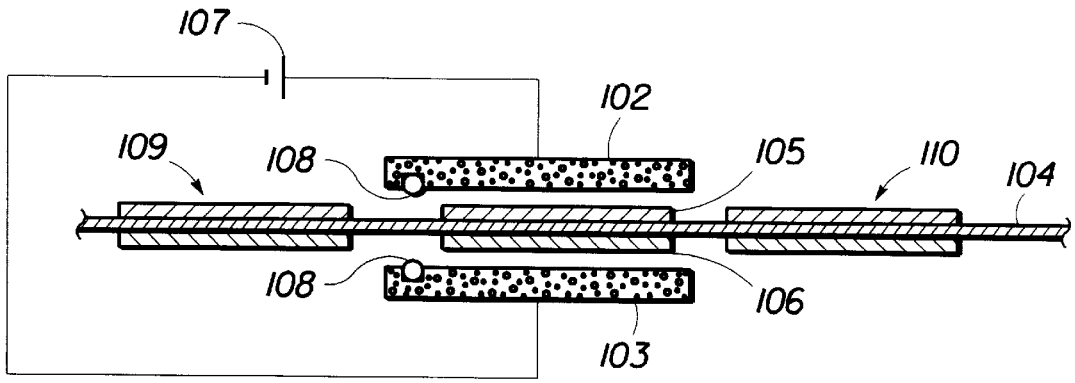
FIG. 1 is a schematic diagram of an ozone generation system having components that are considered extended-use as well as components that are considered limited-use and possibly disposable.

In one embodiment of the invention, the anode catalyst (such as lead dioxide) is deposited or painted onto a first side of a proton exchange membrane (PEM), either continuously or in individual segments. This proton exchange membrane is preferably in the form of a strip that may be coiled to form a compact roll of disposable catalyst/PEM elements. These elements may be advanced into a clamp structure or fixture having an anode contact formed from a suitable material such as porous titanium and a cathode contact formed from a suitable material such as porous stainless steel or stainless steel felt. Either the elements or the clamping structure may also include an elastomer or bead and groove seal that prevents water provided to the active portion of the PEM strip from migrating to the unused portions of the strip where it would have undesirable effects on the unused catalysts. When a new limited-use segment is advanced into this clamp area, it may be hydrated by any means such as immersing in water or by placing water onto the membrane or contacts.

In a similar embodiment, the sealing portion of the elements or clamping structure may be replaced by a system of pinch rollers and/or wiper to prevent the migration of water from the active segment to the unused segment. Additionally, pinch rollers may be used between the active segment and the used segments to 'wring' dry the membrane and catalyst as it leaves to recover as much water for electrolysis as possible.

In another embodiment of the invention, a carrier strip is formed from a suitable material, possibly a hydrophobic material that will not wick water from the active segment to the unused segments. This carrier strip may be divided into segments with each segment representing a limited-use element. Within these elements a suitable membrane may be secured, whether the membrane is to be coated or otherwise placed into contact with the appropriate catalyst(s) on the anode and/or cathode during operation of the cell. In a manner similar to the previous embodiment, these segments are advanced and used in an extended-use fixture, but this embodiment has the advantage that the water used for the reaction is confined to the active segment.

In a related embodiment, to ensure that the unused catalysts and membrane remain dehydrated before use, each segment of the carrier strip described previously may have a border of sufficient width that a protective and sealing film or cover may be stretched across the active portion of the segment and glued, thermally welded, or otherwise adhered to the border around the perimeter. With a protective film placed on each side of the segment, i.e., over the exposed portions of the active area, and the film sealed around the perimeter on each side, each segment is then completely sealed from the environment. Prior to use, these protective films may be peeled back to expose a fresh and completely dehydrated segment that may then be placed into service. In an extreme application, the entire strip or coil of unused segments may be placed in the process water because the film will protect the unused segments until they are exposed for use.

Many of the foregoing embodiments are directed at keeping the membrane and/or catalyst dry, because the PEM is an ion exchange polymer in the protonated or acid form.

The present invention also includes storing electrochemical cells, whether single cells or stacks of cells, in the sodium, potassium or lithium salt form. If a membrane in the salt form becomes wet during storage, the resulting pH will be sufficiently neutral to prevent damage to the catalyst. On a practical basis, storage of cells in the salt form is limited to storage prior to the first use of the cell.

In another embodiment of the invention, the individual segments of the limited-use strip may also include a suitable indicator to indicate when the desired concentration of ozone is reached or to detect a threshold concentration. An example of such an indicator is indigo dye that is known to be bleached and loose its color when exposed to ozone. Color developing indicators are also well known which darken in color as they are exposed to ozone. In this embodiment, either of these indicators could be used in combination with an optical monitor built into the fixture. This optical monitor would then quantify, measure or determine the ozone concentration or whether suitable engagement has occurred. Alternatively, the ozone indicator could be mixed with the anode water rather than being provided separately. An important requirement of the indicator medium would be that it does not place a significant demand on the ozone being generated.

In yet another related embodiment, the indicating system may be spatially separated from the electrolyzer active area so that it is in contact with the process water rather than with the anode water. In this embodiment, the indicator would be fixed to a surface (possibly a transparent film) [Where?] and the ozone concentration of the process water quantified by the single-use color-changing indicator.

In another embodiment of the ozone monitor aspect of this invention, the ozone monitor may be an electrical measurement with a typical example being oxidation-reduction potential (ORP) measurement. Since these measurements are subject to drift and may require calibration, it may be desirable to package limited-use or single-use probes along with other elements on the PEM or carrier strip. This would allow a new set of probes to be used for each cycle thereby minimizing the need for calibration or cleaning of the probes. A separate set of electrical contacts would be provided on the clamping mechanism to provide electronic communication with a controller.

In accordance with the present invention, the source of the water for electrolysis may be delivered to the electrolyzer in any number of ways, including but not limited to pumping from a reservoir, dipping the catalyst into to the water, dripping water onto the catalyst or frits, or wicking the water to the electrolyzer. As another example of water delivery, the system may be mounted vertically with the unused spool of catalyst above the water level of a water reservoir and the used portions of the catalyst simply discharged into the water reservoir. A single set of pinch rollers may then be used to prevent water from wicking out of the water reservoir to the feed spool containing unused segments.

In another embodiment of this invention the water used for the electrochemical reaction may be packaged with the limited-use segments, but in a separate containment device so that the membrane and catalyst remain dry until use. As an example of this embodiment, a small and sealed packet of water would be placed near the active region of the electrolyzer segment and this packet of water pierced or ruptured when the anode and cathode electrical contacts clamp onto the membrane and catalyst. The water in this reservoir will then hydrate the necessary portions of the electrolyzer cell and continue to provide water for electrolysis. As this water is consumed, additional water may be drawn from the prepackaged reservoir until the reservoir is empty. In this manner, each individual limited-use segment of the electrochemical cell provides all consumable materials other than electrical energy. To extend this single-use packaging concept to its extreme, a battery may be included to provide the power necessary for the operation of the electrolyzer. In this embodiment, there may be no other consumable items other than those provided with each single-use or limited-use segment and the remaining functions of the fixture would be limited to activating the cell, advancing the segments, and managing the produced ozone.

It may be desirable to have the catalyst and membrane totally separated during the storage period and only brought into direct contact immediately before activation of the electrolyzer. Therefore, in another embodiment of the invention the catalyst may be deposited to a screen or scrim material that will not degrade the catalyst even if the catalyst and support is moist or wet. Segments of the catalyst may then be formed on a strip of the support screen and this supported catalyst forming the basis of the limited-use device. In this embodiment either the supported catalyst alone may be advanced or the catalyst and a PEM may be both be advanced through the extended-use fixture. Since the catalyst and membrane are separate, they each may be advanced at an individual rate depending upon their lifetime. The PEM, for example, may be advanced when the cell voltage becomes excessive and the catalyst may be advanced when the ozone output degrades below an acceptable level. As an extension of this embodiment, it should be recognized that the physical separation of the catalyst and membrane inherently results in an extended lifetime since the catalyst is removed from the acidic environment of the membrane. Therefore, in a system where physical separation of the catalyst and membrane occur, limited-use may in fact consist of hundreds or thousands of cycles before any degradation of the ozone production is observed.

In a related embodiment, the catalyst may be formed and stored on a separate strip or backing designed for easy release of the catalyst and transfer to another surface. By this design, the catalyst may be transferred from the storage backing and applied to the PEM immediately before use. Depending upon the design of the system, the catalyst may be peeled from the PEM after use and discarded or the PEM may be advanced to a fresh area and a new catalyst patch applied. As with the last embodiment, this embodiment has the distinct advantage that the catalyst roll can get wet as long as the wet support or backing does not result in degradation of the catalyst as would be observed in an acid system such as the proton exchange membrane.

In yet another related embodiment, it may be more desirable to cut segments of supported catalysts from a feed roller completely rather than the above method of transfer from a backing to the membrane or of separately feeding a strip of supported catalyst segments. In this embodiment, a continuous roll of supported catalyst may be cut into segments and applied to either the PEM or to the anode contact immediately before the electrical contacts are clamped to the PEM/catalyst segment. This system has the advantage in that it allows the spatial separation between the wet area and the dry storage area to be increased since the cut segments may be transported from one region to another.

In another embodiment, the anode catalyst is deposited to the anode contact or frit material and extended lifetime of the electrical ozone generator is achieved through the physical removal of the catalyst from the acidic membrane during periods of storage or nonuse. Since the ozone producing catalyst and the membrane are not in contact, the system will not suffer from shelf life problems inherent to existing ozone producing catalysts in contact with the acidic membrane. In this embodiment, the membrane may be packed wet and with sufficient water to provide electrolysis for continued use or water for electrolysis may be provided from another source. The key feature of this embodiment is that the extended-use mechanism is used to separate the anode from the proton exchange membrane whenever electrical power is not being delivered to the electrolyzer system. The mechanism that brings the anode, PEM, and cathode into contact may be driven by a solenoid or other automated device as well as driven manually by the user. Regardless of the actuating mechanism, the anode, membrane, cathode combination may be fully assembled or engaged only during use and while the system is powered and then either automatically or manually disassembled or disengaged when the system is turned off or power is removed. In this manner, the performance of the lead dioxide as a catalyst for ozone evolution will not be degraded by the PEM during periods of nonuse or of low current density settings.

In any of these embodiments, the electrical contacts for the anode and/or cathode may be directly printed, laminated, or otherwise made a part of the limited-use member rather than, or in combination with, the extended-use member. In this embodiment the contacts to the anode and cathode may extend away from the active region or the contacts may both be placed the same side of the electrolyzer. This embodiment may have advantages in material selection, for example, as it is desirable to minimize the number of components exposed to the ozone gas due to corrosion.

In another embodiment of this invention, a hydrophobic film may be placed across the gas generating portions of the ozone generator to prevent the water used for electrolysis from leaving the anode region. More specifically, in a system where the ozone gas is to be engaged in a water or liquid process stream the hydrophobic member will act to prevent the high-quality anode water from mixing with the lower quality process water. Furthermore, in an application where the process water is to be used for consumption and therefore any possibility of lead contamination must be considered, the hydrophobic membrane may achieve the physical separation of the lead containing anode catalyst from the process water. Therefore, in this embodiment the limited-use segment may consist of a hydrophobic strip carrier with PEM segments and a catalyst in contact with the PEM with an electrical lead extending out of the active region while maintaining a tight seal between the hydrophobic strip carrier and the PEM. A method of water delivery or release will provide sufficient water to the electrolyzer so that the system can operate for the desired period of time. Finally, the entire segment is covered with a hydrophobic membrane so the anode water is confined to the immediate region surrounding the anode. With this design, the entire segment may be immersed or exposed to the process water.

In another embodiment, the cathode is provided with a source of air and includes a gas diffusion layer that allows the protons to form water rather than hydrogen, thereby reducing the potential of the electrolyzer as well as eliminating the hydrogen gas stream.

In another embodiment, the cathode is provided with a catalyst or consumable materials designed to convert, adsorb, react with, or otherwise eliminate the hydrogen gas stream that would otherwise be generated during the period of time that the ozone generator is operating.

In certain applications it may be desirable to operate the ozone generator on water that is not of high quality, e.g., tap water. Under these operating conditions, ions in the water supply will reduce the conductivity of the membrane resulting in an increased potential drop across the membrane leading to reduced efficiency and lower net ozone production. Therefore, in another embodiment of the invention, a periodic replacement of the membrane will allow the tap water fed ozone generator to perform at optimum efficiency simply by advancing the membrane. In this embodiment, the limited-use portion of the ozone generator may be the proton exchange membrane only, the catalyst only, or both elements depending upon which failure mechanism is expected to limit the performance of the ozone generator.

FIG. 1 is a schematic diagram of an electrochemical cell, which might be an electrolyzer such as an ozone generation system, having components that are considered extended-use as well as components that are considered limited-use and possibly disposable. The basic elements of a proton exchange membrane (PEM) based electrolyzer are shown by the anode electrical contact 102, the cathode electrical contact 103, the anode catalyst 105, cathode catalyst 106, and a proton exchange membrane 104. The electrochemical cell is attached to and powered by an external power source such as a battery or power supply 107. Of these components, the membrane 104 and catalysts 105, 106 are considered to be limited-use while the contacts 102, 103 and power supply 107 are considered to be extended-use. The catalyst is shown coated onto a strip of membrane such that the catalyst forms segments of active membrane that may be individually used as a portion of the electrochemical cell or electrolyzer system. Furthermore, the anode and cathode electrical contacts may be separated from the catalyst and PEM allowing the limited-use catalyst coated PEM to be repositioned, moved or advanced independently of or relative to the extended-use electrolyzer hardware that constitute the balance of components needed to form the cell.

During operation of the electrochemical cell the anode and cathode electrical contacts 102, 103 are placed or clamped in intimate contact with the anode and cathode catalysts respectively, water is provided to the PEM, and a voltage applied by the power supply 107. While the anode and cathode contacts 102, 103, are clamped to the catalysts and membrane 104, a seal 108 such as an elastomer o-ring disposed on the anode and cathode contacts is used to prevent migration of water from the segment having catalysts 105, 106 to the unused segment having catalysts 105*a*, 106*a* and the remainder of the unused segments.

After use of the electrochemical cell, the anode contact alone or in combination with the cathode contact may be withdrawn, unclamped or disengaged from the active catalyst/PEM/catalyst segment or assembly. In this disengaged position, the catalyst/PEM/catalyst segment may be advanced such that an unused catalyst/PEM/catalyst segment is positioned for use. The contacts are then clamped or pressed against the unused catalysts and the generator is placed back into operation.

Figure 2:
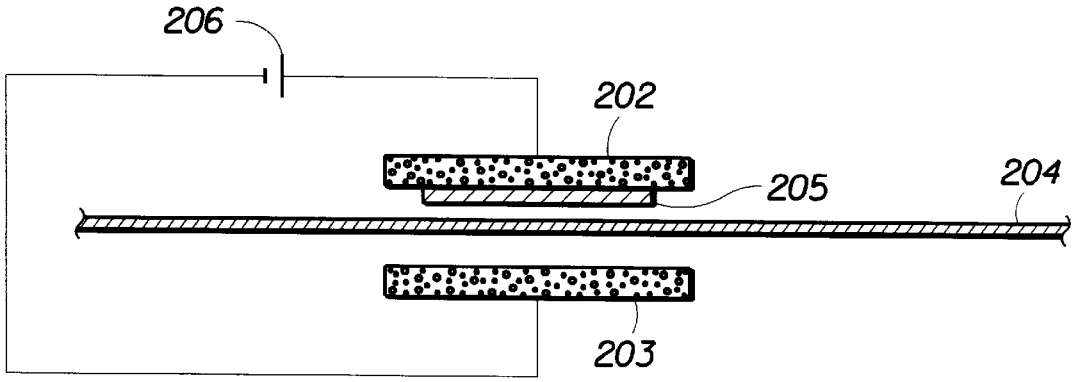
FIG. 2 is a schematic diagram of an alternate embodiment of FIG. 1 having the anode catalyst formed on the anode electrical contact.

FIG. 2 is a schematic diagram of an alternate embodiment of the present invention, in which the anode catalyst 205 is formed onto or remains in contact with the anode electrical contact 202 so that both the catalyst 205 and the contacts 202, 203 are considered to be extended-use components as is the power source 206. In this figure, the anode catalyst 205 is removed or disengaged from contact with the proton exchange membrane 204 during periods when the electrochemical cell, here an ozone generator, is turned off. The physical removal of the anode catalyst away from contact with the PEM eliminates or significantly reduces the damage to the anode catalyst (e.g., lead dioxide for ozone production) that can occur when electrical power is removed from a cell where the catalyst remains in contact with the acidic membrane. In this figure, the cathode catalyst is shown to be the face of the cathode electrical contact rather than a distinct separate catalyst layer. This is most easily accomplished by utilizing the catalytic activity of common metals that may also be used for electrical contact, one such example being stainless steel.

Figure 3A:
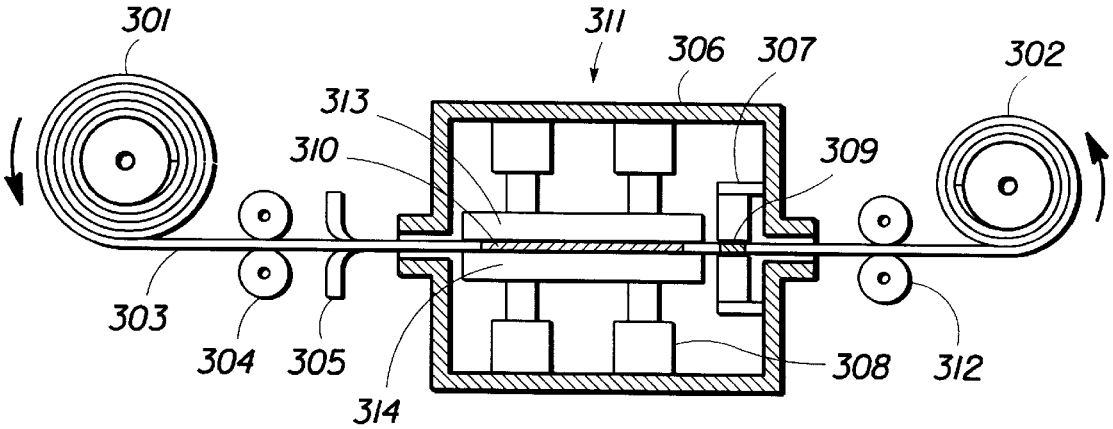
FIGS. 3*a* and 3*b* are side and top view schematic diagrams of an electrochemical ozone generator utilizing the disposable segments.
Figure 3B:
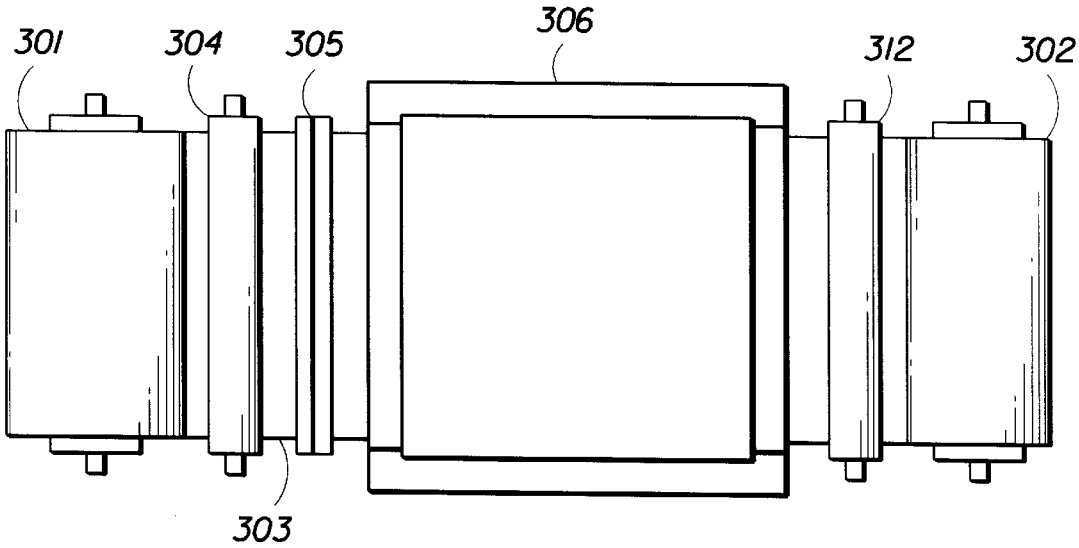

FIGS. 3*a* and 3*b* are schematic side and top views of a system that utilizes limited-use elements, such as those shown schematically in FIGS. 1 and 2. In FIGS. 3*a* and 3*b*, the prepared membrane 303 is shown in a reel-to-reel process that is being fed from a supply or take-off spool 301, being utilized by the extended-use subsystem 311, after which it is coiled onto a take-up spool 302. During use of the active portion of the membrane 310, clamps, solenoids, push button, actuator, or other means or mechanisms 308 for providing motion are used to make and break contact between the membrane 303 and the anode contact 313 and cathode contact 314 shown in FIG. 1 as 102 and 103. The clamping mechanism will typically include a guide member to maintain alignment during disengagement or regain alignment upon reengagement of the electrochemical cell. These guide members may take any form known in the art, but may simply include mounting the electrode contacts 313, 314 to aligned tracks or to a spring-loaded hinge resembling a clothespin. While the guide member deals with aligning the components of the cell, there must also be a way to actuate or bias the electrode contacts between an engaged position and a disengaged position. These actuators may include automated means, such as with solenoids, hydraulic or pneumatic cylinders and the like, or manual means, such as finger-actuated push buttons or triggers that are spring loaded. An example of a push button actuator requiring one push for engagement and a second push for disengagement would be the use of a mechanism like those in retractable ball point pens.

It is also optional to provide mechanisms for incrementally stepping or advancing the array of segments into the active area of the cell. These mechanisms may be simple or complex according to the application and may be operated independently or in connection with the clamping mechanism. One example of a mechanism for clamping the cell in connection with advancing the array of segments in that used in a toy cap gun. In a cap gun, a single trigger disengages a cap, advances the roll of caps to align an individual cap over an anvil, and then releases the biased hammer to engage the cap.

Pinch rollers 304 have been added to prevent water migration from the wet area near the active region 310 of the membrane 303 to the unused membrane spooled as 301. An alternate or supplemental means of preventing water migration may be a non-rotating device such as a wiper 305 shown in this figure. Pinch rollers 312 or a second wiper type mechanism may also be placed on the used membrane to recapture as much water from the membrane as possible before spooling the membrane on the take-up reel 302. A portion of the extended-use system may include a housing 306 designed to confine and direct the gas stream and to confine the water used to wet the membrane and the water required for electrolysis.

The support required for an auxiliary process 309 is also shown in this figure. As examples, this auxiliary process may be used in conjunction with an electrochemical cell that is an ozone generating electrolyzer for the detection or quantification of ozone in the space within the housing 306, indexing of the membrane 303, detection or monitoring of the ozone in the process stream, or any other analysis of the membrane, catalysts, anode water, process water, gas or gas spaces, etc. In this figure, the auxiliary or supplemental process 309 is shown to have both an extended-use component, such as an optical sensor, and a limited use component, such as ozone sensitive patch.

Figure 4:
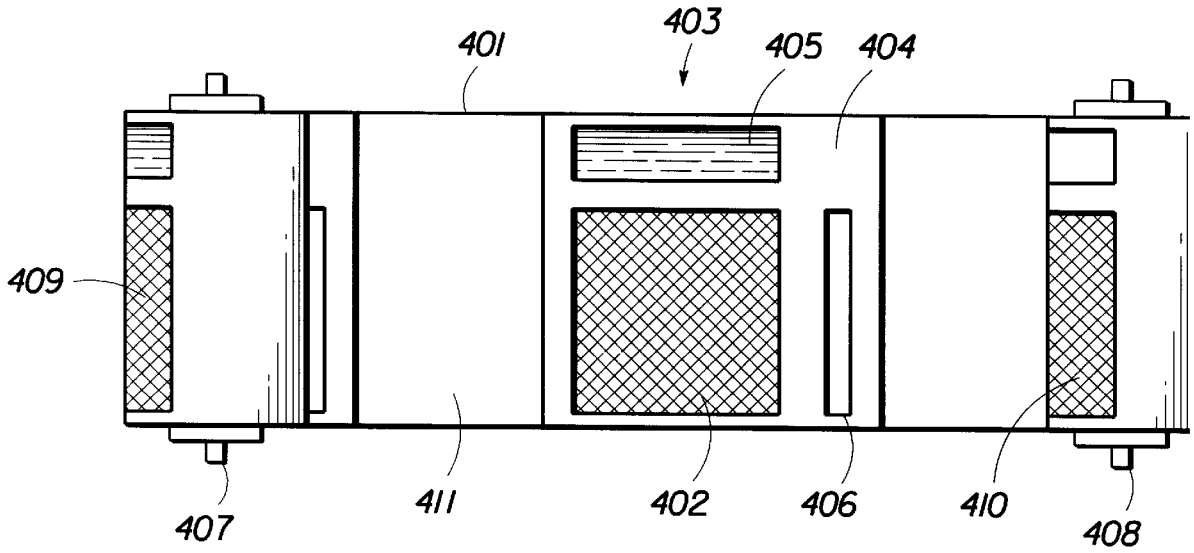
FIG. 4 is a detailed schematic diagram of a disposable segment composed of three sub-elements such as ozone concentration indicator and electrolyzer water source.

FIG. 4 is a schematic top view of an array of limited-use segments formed on membrane stored in a roll. The active segment of the membrane 403 is subdivided to include the active catalyst 402 and supporting processes or materials 405, 406. This collection of limited-use components represents one segment 403, preferably having individual subcomponents, elements or materials that have comparable lifetimes. One example of subsystems packaged with the membrane 402 include color indicating or color eliminating dye patches 406 for the measurement of ozone concentration. Another example is a reservoir of water that may be used for electrolysis and to hydrate the membrane. In this example, the water may be contained in a sealed reservoir 405 which is ruptured, pierced, or otherwise tapped to provide water for electrolysis and/or hydration of the membrane.

FIG. 4 also shows a method of preventing water wicking from the active area to unused areas through the use of hydrophobic materials or materials treated to prevent the migration of water. The example shown in FIG. 4 includes a hydrophobic region 404 that is subdivided to include the active region of the membrane and catalyst 402 as well as a supporting subsystem 406 and a possible water storage 405. To eliminate or reduce the necessity of pinch rollers or other active methods of water control, the active segment may be separated from the other new and unused segments by an area of additional hydrophobic, treated, or other carrier material 411. Therefore, the system may represent a segmented strip having a carrier material, for example a hydrophobic material such as Mylar, Teflon, or other suitable material or plastic, that contains many segments each of which is subdivided or may contain subunits. This strip may then be handled on a reel-to-reel process as shown in FIG. 4 with the unused segments 409 on a take-out reel 407 and the used segments 410 collected on a take-up spool.

Figure 5:
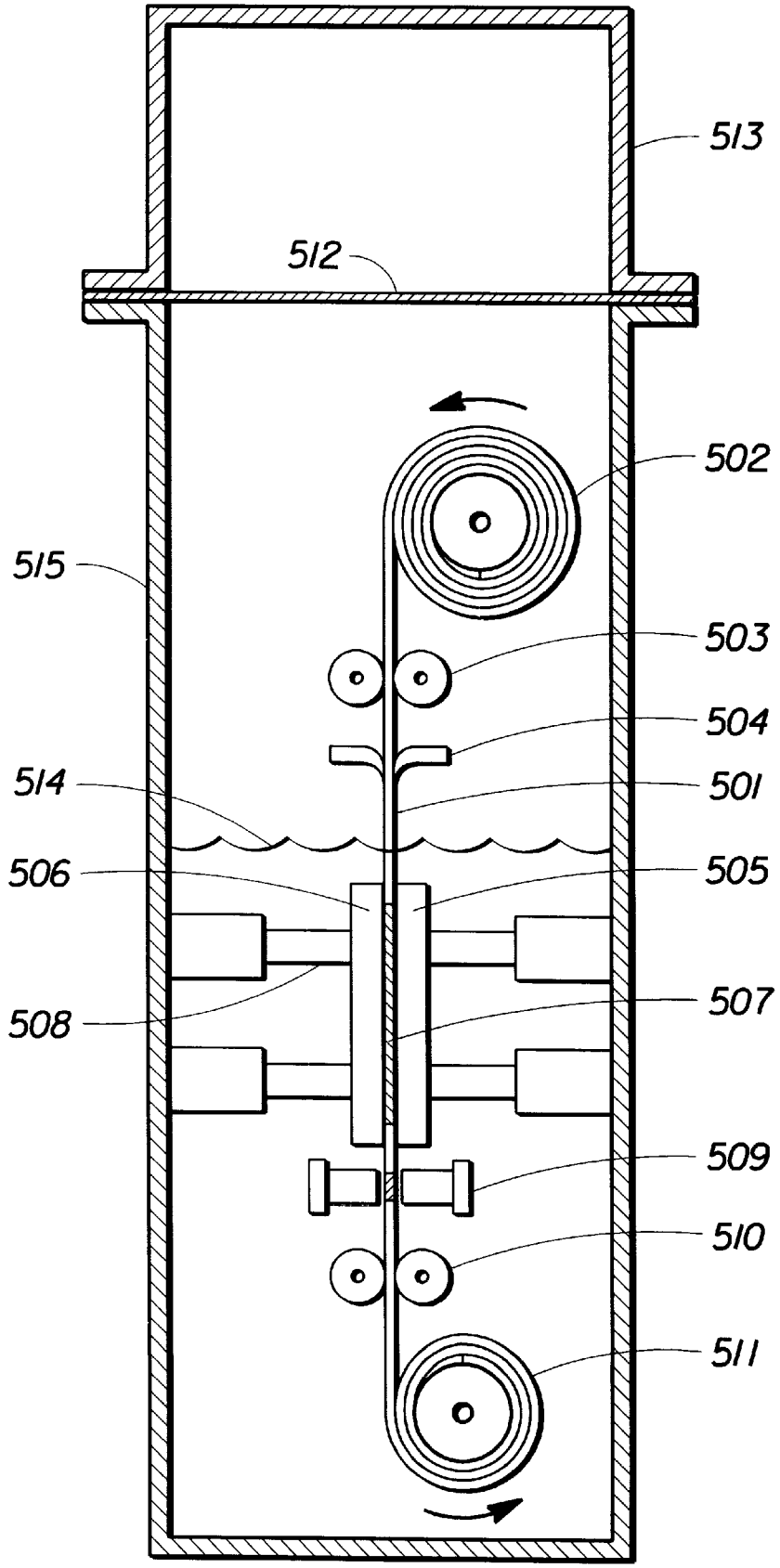
FIG. 5 is a cross section of the electrolytic ozone generator having a vertical orientation and a flooded electrolyzer region.

FIG. 5 is a schematic diagram of an electrochemical cell, perhaps an electrolyzer such as an ozone generator, which utilizes the reel-to-reel apparatus for handling or managing the limited-use components. In this figure, the unused segments are taken from the take-out spool 502 and clamped in the anode 505 and cathode 506 contact surfaces. These contact surfaces are moved by actuators 508 that may include, but are not limited to, solenoids, hydraulic cylinders, pneumatic cylinders, springs and other biasing members. Water is prevented from wicking up to the unused segments by pinch rollers 503 and wiper 504. It should be noted that an alternate design may further reduce the water available by the unused membrane by positioning the supply or take-out spool 502 outside the main container 515. In this schematic, the active area of the catalyst 507 is completely submerged under the water level 514. Alternate embodiments may be envisioned wherein the active membrane may take various positions with the water and be above the water level, partially submerged, or completely below the water level. FIG. 5 also includes a secondary process 510 having both a multi-use and limited-use components as well as rollers 510 and take-up spool 511. The region 515 of the electrolyzer having the reel-to-reel mechanism may be separated from a secondary region 513 by a structure 512 providing distinct separation of the regions 513, 515. One such exemplary structure is a hydrophobic membrane designed to prevent water mixing from the mechanism region 515 with the headspace or possibly ozone engagement or utilization region 513.

Figure 6:
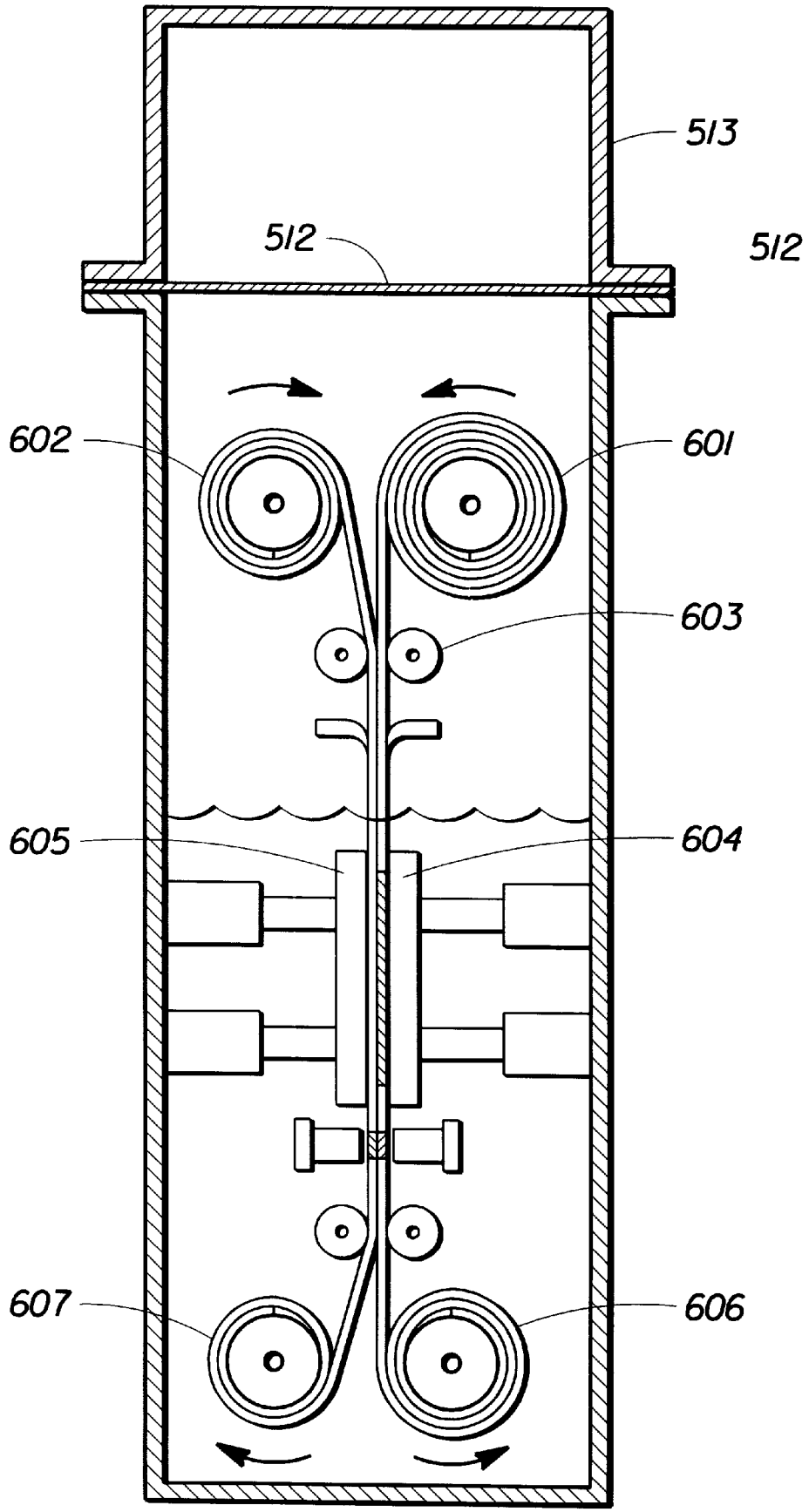
FIG. 6 is a schematic of a mechanism supplying the catalyst and membrane from separate feeds and laminated at the time of use.

FIG. 6 is a schematic diagram of a system wherein the limited-use member is composed of two or more parts that are manufactured, stored, or installed separately and then combined or placed in intimate contact prior to use. In the example shown in this figure, the proton exchange membrane may be taken from one feed reel 602 while the catalyst is taken from a second feed reel 601. A scrim, screen, or other carrier suitable for the application may support the catalyst. In the specific example of an electrochemical ozone generator, this embodiment has the added advantage that the moisture content of the catalyst and of the membrane does not cause degradation until the two are in contact. Therefore, both the membrane and catalyst may coexist in the same region and under the same conditions prior to their being placed in contact. In the extreme condition, this would allow both components to be fully hydrated or even submerged for extended periods prior to use without degradation or adverse results.

FIG. 6 shows the material from the individual take-out spools 601, 602 placed in intimate contact first by the optional pinch rollers 603 and ultimately by the anode and cathode contacts 604, 605. After use, the two materials may be coiled around separate take-up spools 606, 607 or the laminated materials could be combined onto one spool.

Figure 7:
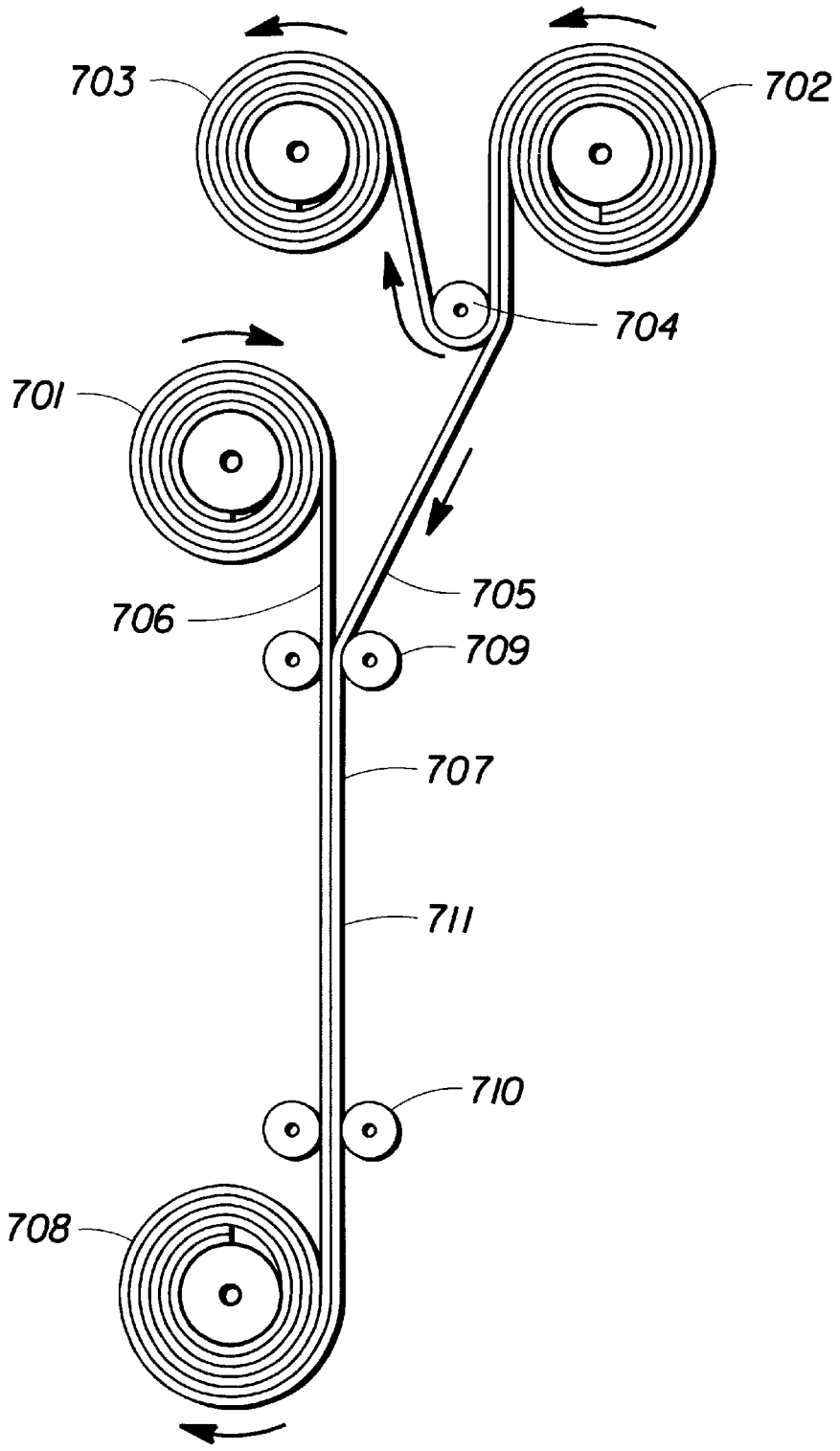
FIG. 7 is a schematic diagram of a membrane and catalyst feed mechanism that removes a protective layer from the catalyst surface before use.

FIG. 7 is a schematic diagram of a delivery system whereby the catalyst is held on a backing material and covered with a removable protection material. The catalyst is provided along with its backing and protection material by a take-out spool 702 and the protection material is removed prior to use by roller 704 and the protection strip collected on a take-up spool 703. The catalyst and backing material 705 is then placed in contact with the membrane or complementary material 706 being provided by a second feed spool 701. The two materials are then laminated forming an active area 711 that is coiled around a take-up spool 708 after use. Various rollers such as pinch rollers 709, 710 are provided to control the physical handling of the feed materials.

Figure 8:
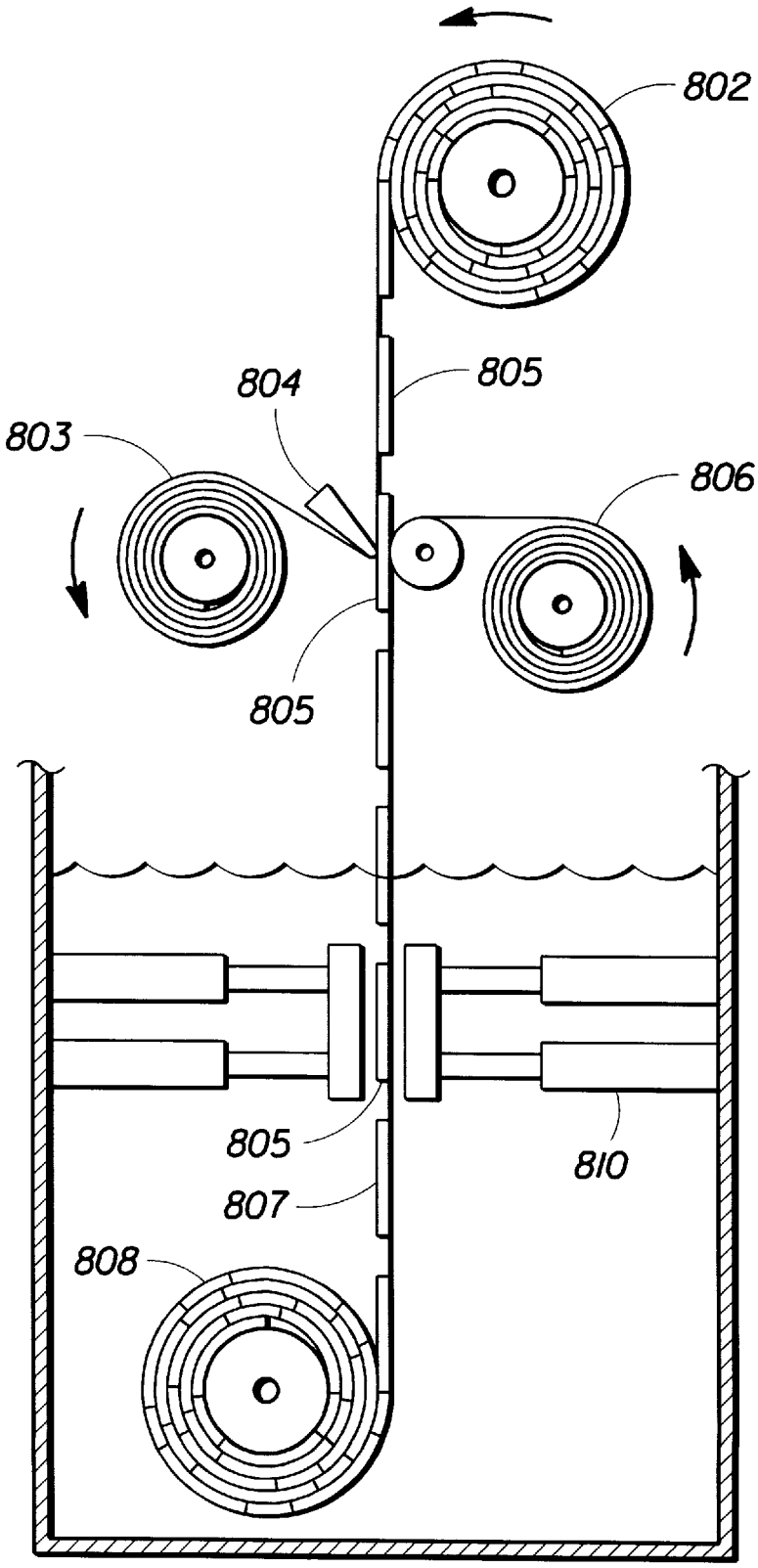
FIG. 8 is a schematic diagram of a membrane and catalyst feed mechanism that removes the catalyst from a carrier strip and transfers them to the membrane before use.

FIG. 8 is a schematic similar to FIG. 7 but where the catalyst is provided with a removable backing material. In this figure the catalyst and backing material are taken from a feed spool 802 and the catalyst separated from the backing material by a roller or other device 804 and the backing material collected on a take-up spool 803. The catalyst segments 805 are transferred to the proton exchange membrane 806 and the active segment 808 is provided to the active area between the electrode contacts and clamping mechanism 810. Used membrane and catalyst may be collected on a take-up reel 808 as desired. In an alternate operation method, the system may be bi-directional wherein a specific catalyst segment may be applied to the membrane and then used for a period of time. When the electrolyzer is cycled off, the rollers may be rotated in reverse such that the catalyst segment is replaced onto the backing material so that it is separated from the proton exchange membrane. The catalyst may then be reused while being separated from the PEM between each use. After the useful lifetime of the catalyst, a completely fresh catalyst segment may be applied to the PEM and the unusable catalyst 807 and membrane accumulated on a take-up spool 808. Alternatively, the used catalyst segments may be removed from the membrane and disposed separately.

Figure 9:
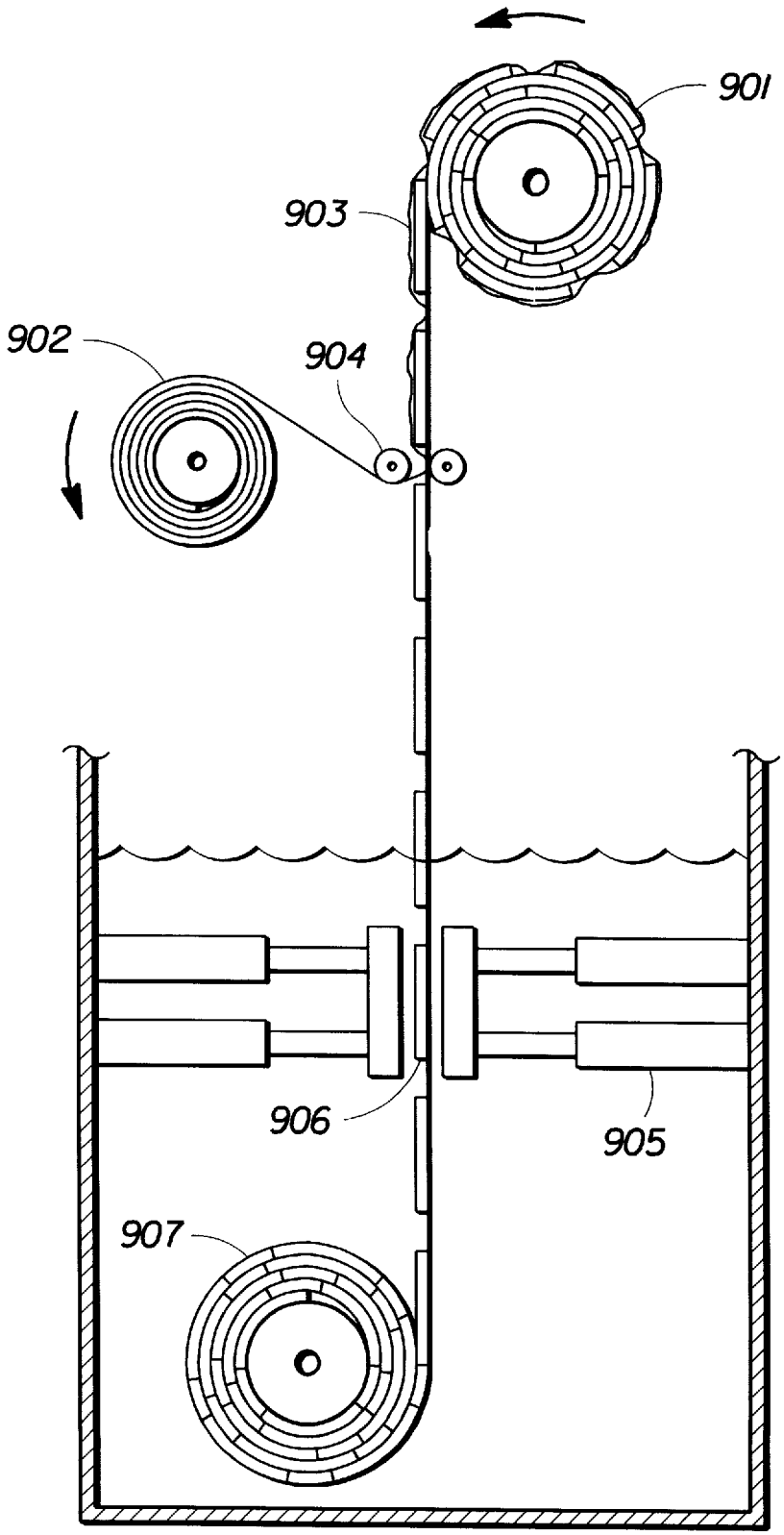
FIG. 9 is a schematic diagram of a membrane and catalyst feed mechanism that removes a protective layer from the segments before use.

FIG. 9 is a schematic diagram of a supply mechanism that peels a protective layer from the segments, here including a catalyst and PEM. In this figure, the catalyst and PEM segments are supported by a hydrophobic carrier strip like that shown in FIG. 4. Each catalyst and PEM segment 901 is covered and sealed by a protective layer 902 that is bonded, glued, welded, or otherwise held or secured to the carrier strip such that a moisture tight seal is made. This seal is broken as the protective member is removed, by rollers, knife, or other mechanism 904, from the segment prior to use in the clamping mechanism 905. In this manner, the unused PEM will be unable to take up water from the environment, etc., so that the catalyst and membrane can be stored in intimate contact for extended periods before use without damage or degradation. Used segments 906 may then be wound around a take-up spool 907 or otherwise managed or disposed.

Figure 10:
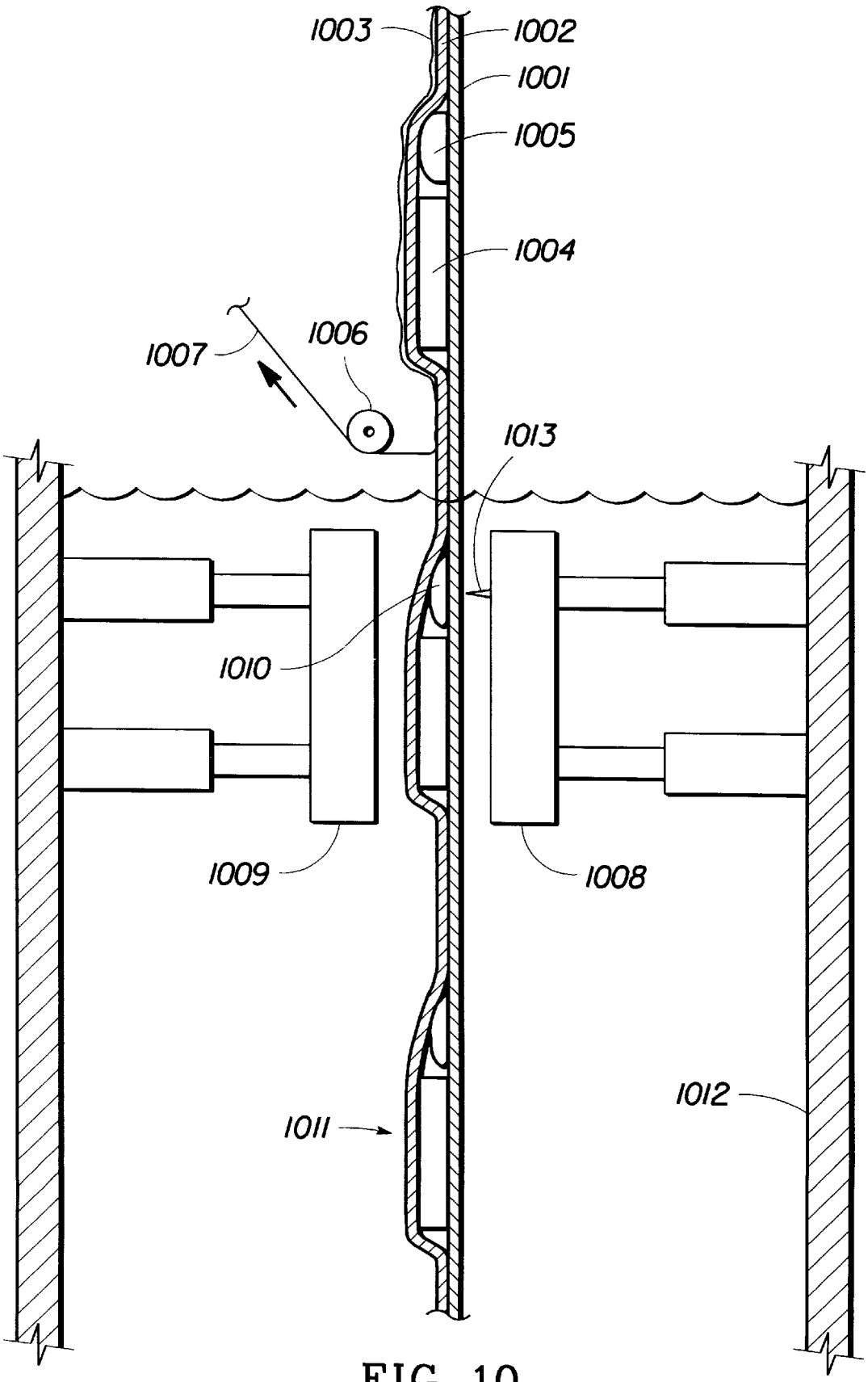
FIG. 10 is a schematic of a membrane and catalyst strip system that includes a hydrophobic member over each active segment.

FIG. 10 is a schematic of a supply mechanism that provides a phase separation layer as a component in the limited-use material of the generator. In this figure, the segment carrier 1001 containing catalyst segments 1004 and sealed water reservoirs 1005 is covered with a hydrophobic element 1002 which may be placed either continuously over the length of the carrier 1001 or just over the active area of each segment. Preferably, a removable material 1007 which is glued, thermally welded, or otherwise bonded to the segment or more preferably to the carrier strip 1001 forming a moisture tight or resistant seal enclosing at least the portion of the segment having the catalyst and PEM then seals the active area segment. Prior to use, the sealing strip 1007 is removed leaving the hydrophobic member as the exposed element over the active segment. The internal water reservoir 1010 is then ruptured, pierced, or otherwise allowed to release its contents, such as by a sharp protrusion 1013 extending from the face of the electrode contact or by pressure applied between the two electrode contacts, so that water is taken up by the membrane and catalyst. Electrical contact is made by anode contact 1009 and cathode contact 1008. During operation of the electrolyzer, the water used for electrolysis, which was provided entirely or in part by the included water reservoir 1005, 1010, is retained in the active segment by the hydrophobic membrane 1002 and the carrier strip 1001. This provides a means of separating the pure anode water from materials or water in the process region 1012 surrounding the segments and the cell. Used segments 1011 are discarded or accumulated by a take-up spool as in the other figures. It is also possible that the contacts to the anode and cathode catalysts may be provided by a limited-use component and discarded with the catalyst and membrane. These contacts may be vapor deposited, painted, or otherwise formed directly onto the catalyst or backing materials or may be a metallic screen that is laminated with the other members of the limited-use segment.

Figure 11:
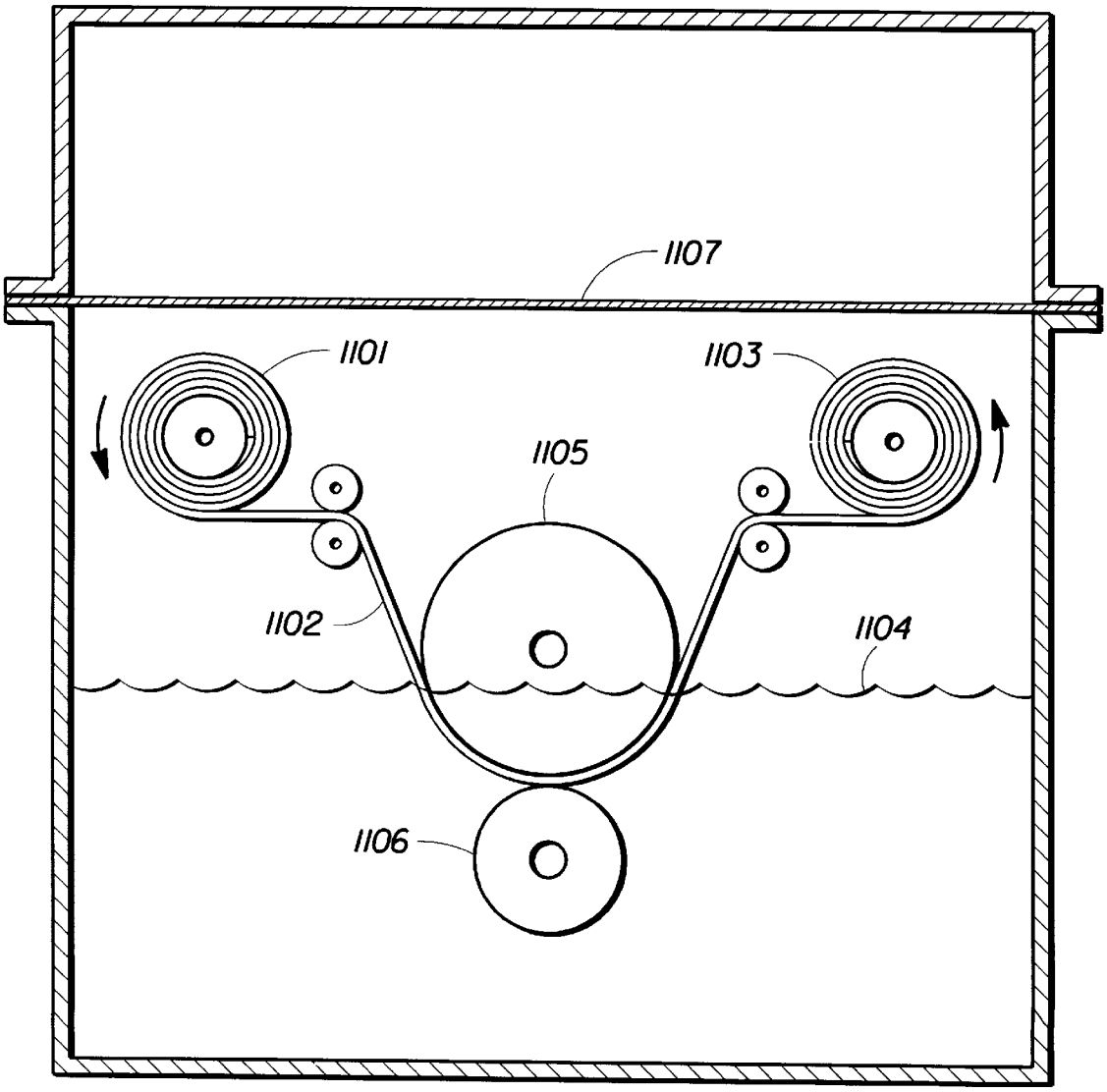
FIG. 11 is a simplified schematic diagram of a system making electrical contact to the active region with rollers rather than with plates.

FIG. 11 is a schematic diagram showing an alternative method of electrical contact to the active segment other than a flat clamping mechanism. In this figure the unused segments are held on supply spool 1101 and transferred to a takeup spool 1103 after use. The segment and carrier strip 1102 is placed between rollers 1105, 1106 to provide electrical contact to the active segment. To increase the electrical contact area, a metallic screen or other means of distributing the current may be added to the active segment so that the electrical contact of the outside roller 1106 with the segment does not limit the cross-sectional area of the active region of the catalyst. The electrochemical device is shown in a housing having a hydrophobic, gas permeable membrane separator 1107 spanning across the housing to allow generated gases, such as ozone/oxygen gas from an ozone electrolyzer, to be separated.

Figure 12:
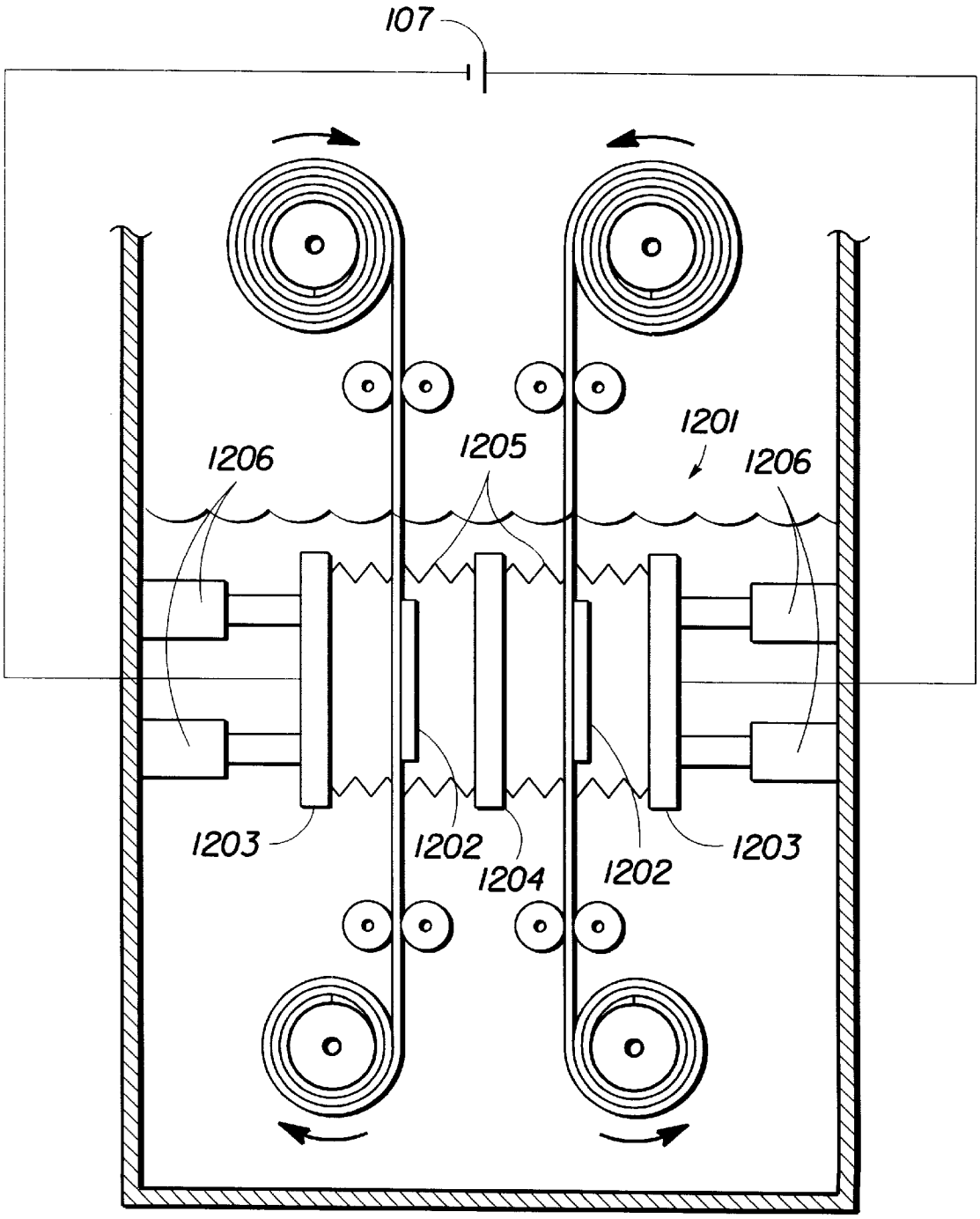
FIG. 12 is a schematic side view of a filter press type stack of electrochemical cells for use with multiple arrays of segments.

It should be recognized that the present invention may also be applied to use with a plurality of electrochemical cells simultaneously, whether such cells are operated independently, in parallel or in series. In FIG. 12 it is shown that the invention may be used in conjunction with a filter-press type electrochemical cell stack 1201 by providing for the limited-use segments 1202 to be positioned between the extended use components, including endplates 1203 and bipolar plate 1204. Disengagement of a plurality of electrode contacts within the stack, for example bipolar plates and endplates, may be accomplished by using springs 1205 secured to adjacent bipolar plates or endplates and biased to urge the plates towards disengaging the segments therebetween. One or more actuators 1206 may then be used to compress the stack and overcome the bias forces of the springs 1205 to bring the bipolar plate 1204 and endplates 1203 into contact with the segments 1202.

The present invention, set out in the foregoing descriptions and figures, provides the advantage of extending the useful lifetime of an electrochemical cell and electrochemical cell components by allowing individual components or groupings of components to be replaced as necessary without discarding other components that do not need to be replaced. In particular, a PEM contaminated by the water source or a catalyst degraded by contact with an acidic PEM can be replaced without laborious disassembly of the electrochemical device. Rather the invention facilitates replacement of limited-use segments or otherwise reduces the degradation that can occur otherwise. Therefore, the electrochemical devices of the present invention are assembled and operated without the use of heavy tie bolts. In the case of ozone electrolyzers, acidic degradation of the lead dioxide anode catalyst is either eliminated or managed without the use of a battery backup or application of a reverse potential.

The term "comprising" means that the recited elements or steps may be only part of the device and does not exclude additional unrecited elements or steps.

While the foregoing is directed to the preferred embodiment of the present invention, other and further embodiments of the invention may be devised without departing from the basic scope thereof, and the scope thereof is determined by the claims that follow.

What is claimed is:

1. An apparatus comprising:

an electrochemical cell having an anode, a cathode, and an ion exchange membrane disposed in an engageable position between the anode and the cathode;

a clamping mechanism coupled to the anode and the cathode and allowing relative movement of the anode and cathode between a disengaged position and an engaged position providing ionic communication through the ion exchange membrane; and an anodic electrocatalyst permanently formed onto the anode.

2. The electrochemical device of claim 1, wherein the anodic electrocatalyst is lead dioxide.

3. The electrochemical cell of claim 1, wherein the disengaged position provides physical separation of the anodic electrocatalyst from the ion exchange membrane.

4. The electrochemical cell of claim 3, wherein the anodic electrocatalyst and the ion exchange membrane are physically separated during inactivity of the electrochemical cell.

5. The electrochemical cell of claim 3, wherein the ion exchange membrane is a proton exchange membrane having functional groups that form acids in the presence of water.

6. The electrochemical cell of claim 5, wherein the proton exchange membrane comprises a perfluoronated sulfonic acid polymer.

7. The electrochemical cell of claim 1, further comprising:

means for delivering unused portions of the ion exchange membrane into alignment with the anode by handling portions of the ion exchange membrane that extend beyond the anode while the anode and the cathode are disengaged.

8. The electrochemical cell of claim 7, wherein the means for delivering comprises a supply reel maintaining unused portions of the ion exchange membrane and a takeup reel collecting used portions of the ion exchange membrane.

9. The apparatus of claim 1, wherein the clamping mechanism comprises a guide member to align the anode and cathode.

10. The apparatus of claim 1, wherein the clamping mechanism comprises an actuator to bias the anode between an engaged position and a disengaged position.

11. The apparatus of claim 10, wherein the actuator is selected from solenoids, hydraulic cylinders, pneumatic cylinders, push buttons and triggers.

12. The apparatus of claim 1, wherein the clamping mechanism comprises an actuator to bias the cathode between an engaged position and a disengaged position.

13. The apparatus of claim 12, wherein the actuator is selected from solenoids, hydraulic cylinders, pneumatic cylinders, push buttons and triggers.

14. An apparatus comprising:

an electrochemical cell having an anode, a cathode, and an ion exchange membrane disposed in an engageable position between the anode and the cathode;

a clamping mechanism coupled to the anode and the cathode and allowing relative movement of the anode and cathode between a disengaged position and an engaged position providing ionic communication through the ion exchange membrane;

an array of anodic electrocatalyst patches deposited on the ion exchange membrane facing the anode; and means for delivering individual anodic electrocatalyst patches into alignment with the anode by handling portions of the ion exchange membrane that extend beyond the anode.

15. The electrochemical cell of claim 14, further comprising:

means for preventing water wicking through the membrane from the aligned portion of the array to adjacent anodic electrocatalyst patches.

16. The electrochemical cell of claim 15, wherein the means for preventing water wicking comprises a pair of rollers on opposing sides of the ion exchange membrane between the active area and a supply of unused anodic electrocatalyst patches.

17. The electrochemical cell of claim 16, further comprising a pair of rollers on opposing sides of the ion exchange membrane between the active area and the portion of the ion exchange membrane having used anodic electrocatalyst patches.

18. The electrochemical cell of claim 14, wherein the ion exchange membrane is an elongated strip.

19. The electrochemical cell of claim 18, wherein the strip is provided in a roll.

20. The electrochemical cell of claim 14, further comprising a selectively rupturable water reservoir secured to the ion exchange membrane adjacent each anodic electrocatalyst patch, wherein rupturing of the reservoir delivers water to the membrane in a region between the anode and the cathode.

21. The electrochemical cell of claim 14, further comprising:

an ozone indicator patch secured to the ion exchange membrane adjacent each anodic electrocatalyst patch; and an optical probe for measuring color changes of the ozone indicator patch.

22. The electrochemical cell of claim 14, wherein the clamp has a sealing member disposed around the perimeter of the anode to prevent water wicking to unused anodic electrocatalyst patches.

23. An apparatus comprising:

an electrochemical cell having an anode, a cathode, and an ion exchange membrane disposed in an engageable position between the anode and the cathode;

a clamping mechanism coupled to the anode and the cathode and allowing relative movement of the anode and cathode between a disengaged position and an engaged position providing ionic communication through the ion exchange membrane;

an array of anodic electrocatalyst patches deposited on a scrim;

means for delivering unused anodic electrocatalyst patches into alignment with the anode by handling portions of the scrim that extend beyond the anode; and means for delivering unused portions of the ion exchange membrane into alignment with the anode by handling portions of the ion exchange membrane that extend beyond the anode while the anode and the cathode are disengaged.

24. In an electrochemical cell having an anode, anodic electrocatalyst, ion exchange membrane, cathodic electrocatalyst, and a cathode defining an active area, the improvement comprising:

(a) one or more components selected from the anode, the anodic electrocatalyst, the ion exchange membrane, the cathodic electrocatalyst, and the cathode being selectively positionable within the active area.

25. An electrochemical cell comprising:

an anode, anodic electrocatalyst, an ion exchange membrane, cathodic electrocatalyst, and a cathode defining an active area of the electrochemical cell;

an array of one or more limited-use components, the array being configured to allow individual limited-use components in the array to be aligned with one or more extended-use components; and an alignment member for controllably aligning unused limited-use components with the extended-use components.

26. A subassembly for an electrochemical cell comprising:

an array of duplicate components for forming a part of the electrochemical cell having an active area, wherein individual components in the array are physically interconnected to allow alignment of the individual components with the electrochemical cell by handling portions of the array that extends beyond the active area.

27. The subassembly of claim 26, wherein the duplicate components are selected from a proton exchange membrane, an anion exchange membrane, an anodic electrocatalyst, a cathodic electrocatalyst, and combinations thereof.

28. The subassembly of claim 27, further comprising an ozone indicator patch adjacent each of the components in the array.

29. The subassembly of claim 26, wherein the individual components in the array are physically interconnected by a continuous ion exchange membrane.

30. The subassembly of claim 26, wherein the individual components in the array are physically interconnected by a hydrophobic carrier strip.

31. The subassembly of claim 26, wherein the individual components in the array are physically interconnected by a screen.

32. The subassembly of claim 26, wherein the individual components are electronically isolated from adjacent components in the array.

33. The subassembly of claim 26, wherein the duplicate components have a surface area that is greater than the active area.

34. The subassembly of claim 26, wherein the array of duplicate components form a strip.

35. The subassembly of claim 34, wherein the strip is rolled up.

36. The subassembly of claim 34, wherein the strip is rolled up on a reel.

37. The subassembly of claim 26, wherein the individual components in the array are stored in a plastic wrap that seals out moisture.

38. The subassembly of claim 26, further comprising a water reservoir adjacent each of the components in the array.

39. A method of replacing a used component of an ion exchange membrane electrochemical cell, comprising:

(a) releasing a used subassembly of the electrochemical cell from contact with adjacent components of the electrochemical cell;

(b) advancing an array of the subassemblies to align an unused subassembly with adjacent components of the electrochemical cell; and (c) engaging the aligned, unused subassembly with the adjacent components of the electrochemical cell.

40. The method of claim 39, wherein steps (a)–(c) are performed with each shutdown of the electrical current to the electrochemical cell.

41. The method of claim 39, wherein steps (a)–(c) are performed following detection of a cell voltage greater than a setpoint voltage.

42. The method of claim 39, wherein steps (a)–(c) are performed following detection of an ozone output less than a setpoint ozone output.

43. The method of claim 39, further comprising the step of maintaining the unused subassemblies dry until they are advanced into the electrochemical cell.

44. The method of claim 39, wherein an array of electrocatalyst subassemblies are periodically advanced to avoid acidic corrosion of the catalyst.

45. The method of claim 39, wherein the ion exchange membrane is periodically advanced to avoid tap water contamination of the membrane.

46. The method of claim 39, wherein steps (a)–(c) are performed with each startup of the electrical current to the electrochemical cell.

* * * * *